US011757200B2

(12) United States Patent
Ding et al.

(10) Patent No.: US 11,757,200 B2
(45) Date of Patent: Sep. 12, 2023

(54) ACTIVE-PASSIVE INTEGRATED ANTENNA

(71) Applicants: PROSE TECHNOLOGIES (SUZHOU) CO., LTD., Jiangsu (CN); PROSE Technologies LLC, Mount Olive, NJ (US)

(72) Inventors: Dongfeng Ding, Jiangsu (CN); Song Wang, Jiangsu (CN); Xin Zhao, Jiangsu (CN)

(73) Assignee: PROSE TECHNOLOGIES (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 18/097,500

(22) Filed: Jan. 17, 2023

(65) Prior Publication Data

US 2023/0238709 A1 Jul. 27, 2023

(30) Foreign Application Priority Data

Jan. 25, 2022 (CN) ..... 202220205147.4

(51) Int. Cl.
*H01Q 15/23* (2006.01)
*H01Q 13/10* (2006.01)
*H01Q 1/42* (2006.01)

(52) U.S. Cl.
CPC ..... *H01Q 15/23* (2013.01); *H01Q 1/42* (2013.01); *H01Q 13/106* (2013.01)

(58) Field of Classification Search
CPC ..... H01Q 15/23; H01Q 1/42; H01Q 13/106
See application file for complete search history.

(56) References Cited

U.S. PATENT DOCUMENTS

2021/0305717 A1* 9/2021 Hou ..... H04B 7/0617

FOREIGN PATENT DOCUMENTS

CN 215497084 U * 1/2022 ..... H01Q 15/00
WO WO-2021222217 A1 * 11/2021 ..... H01Q 1/246

* cited by examiner

*Primary Examiner* — Hoang V Nguyen

(57) ABSTRACT

An active-passive integrated antenna is provided. The active-passive integrated antenna includes a reflective plate, a pair of mounting portions respectively secured to two sides of a bottom of the reflective plate, a dielectric plate, a plurality of passive antenna elements and an active antenna unit. More specifically, the dielectric plate is spaced apart from the reflective plate on the pair of mounting portions, and a first surface of the dielectric plate is provided with a frequency selection surface; the plurality of passive antenna elements are respectively arranged on the reflective plate and the frequency selection surface; the active antenna unit is arranged above a second surface of the dielectric plate and secured to the pair of mounting portions.

16 Claims, 6 Drawing Sheets

ACTIVE-PASSIVE INTEGRATED ANTENNA

FIELD

Embodiments of the present disclosure generally relate to the mobile communication field, and more specifically, to an active-passive integrated antenna.

BACKGROUND

Accompanied with the development of the information and communications technologies such as the mobile internet, the internet of things and the like, recent years witness a continuous, explosive increase of data traffic. The number of 5G base stations is increased rapidly, causing the shortage of site resources to be more apparent. To implement fast deployment, a 5G site is mainly provided by adding 5G antennas and devices to the original 4G site resources, and multi-frequency base station antennas thus become the mainstream. Due to advantages in space size, wind load and management, 4G and 5G integrated A+P base station antennas (i.e., active-passive integrated antennas) are widely accepted and applied in the 5G base station deployment, which is an important trend in the future base station evolution.

In the actual application, an integrated antenna is often suspended at a height of tens of meters. Accordingly, when a wind blows over the surface of the antenna cover, vortices and airflow separation will arise to bring about a complicated air force that can make the base station antennas vibrate. In addition, the current mainstream site building model of most base station antennas utilizes a single-tube communication tower of a steel structure. However, such a communication tower has disadvantages that the tower body has low rigidity, the tower top may generate a too great horizontal displacement, and the like. Besides, an active antenna often weighs more than 20 Kg, while an integrated antenna weighs more than 50 Kg, which may cause the vibrations to be stronger. Therefore, based on the existing active antenna and passive antenna, there arises a need for an integrated antenna that can be reliable combination of the two.

SUMMARY

In view of the above-mentioned problem, the disclosure proposes an active-passive integrated antenna, comprising:

- a reflective plate;
- a pair of mounting portions respectively secured on two sides of a bottom of the reflective plate;
- a dielectric plate spaced apart from the reflective plate on the pair of mounting portions, a first surface of the dielectric plate being provided with a frequency selection surface;
- a plurality of passive antenna elements respectively arranged on the reflective plate and the frequency selection surface; and
- an active antenna unit arranged above a second surface of the dielectric plate and secured to the pair of mounting portions, wherein the second surface is located opposite to the first surface.

According to an implementation of the disclosure, the integrated antenna further comprises an antenna cover, the reflective plate, the pair of mounting portions, the dielectric plate and the plurality of passive antenna elements are arranged within the antenna cover, and the active antenna unit is secured to the antenna cover and the pair of mounting portions.

According to an implementation of the disclosure, each of the mounting portions is entirely in a hollow rod shape.

According to an implementation of the disclosure, each of the mounting portions has a trapezoidal section and is provided with a reinforcement rib to make the trapezoidal section to be formed by two triangles.

According to an implementation of the disclosure, the mounting portion comprises a first side surface and a second side surface parallel to each other, the reflective plate and the dielectric plate are respectively arranged on the first side surface, and the active antenna unit is arranged on the second side surface; wherein the first side surface has a first section length, the second side surface has a second section length, and the first section length is less than the second section length.

According to an implementation of the disclosure, each of the mounting portions has a rectangular section.

According to an implementation of the disclosure, the mounting portion is further provided therein with a reinforcement rib such that the section is divided into two portions.

According to an implementation of the disclosure, the mounting portion comprises a first side surface and a second side surface parallel to each other, and a third side surface and a fourth side surface respectively perpendicular to the first side surface, the reflective plate and the dielectric plate are respectively arranged on the first side surface, and the active antenna unit is arranged on the second side surface.

According to an implementation of the disclosure, each of the mounting portions is further provided with a plurality of through holes that are spaced apart on the third side surface and the fourth side surface, respectively.

According to an implementation of the disclosure, the plurality of through holes correspond to a plurality of active radiating elements of the active antenna unit, respectively, when the active antenna unit is arranged on the second side surface.

According to an implementation of the disclosure, at least a part of a radiating surface of one of the active radiating elements is horizontally aligned with a first edge of a corresponding one of the through holes, wherein the first edge of the through hole is proximal to the active antenna unit.

According to an implementation of the disclosure, a radiating surface of one of the active radiating elements is horizontally aligned with first edges of adjacent two of the through holes.

According to an implementation of the disclosure, each of the mounting portions is further provided with a plurality of lightening holes arranged on the first side surface and the second side surface.

According to an implementation of the disclosure, the active antenna unit comprises a first side and a second side opposite to each other, and the first side further comprises a connecting portion connected to the antenna cover.

According to an implementation of the disclosure, the integrated antenna further comprises:

- a first mounting bracket secured to the antenna cover and the pair of mounting portions and comprising a first hoop structure; and
- a second mounting bracket arranged on the second side and comprising a second hoop structure and an adjustable member connected to the second hoop structure.

According to an implementation of the disclosure, the integrated antenna further comprises: a support bracket that is respectively connected at two ends with the pair of mounting portions such that the connecting portion is secured to the antenna cover and the support bracket.

Utilizing a pair of mounting portions having an active antenna unit and a passive antenna unit secured thereon, the integrated antenna according to the disclosure can solve the safety and reliability problem of the integrated antenna in use, and can further solve the problem of material waste caused by openings on the reflective plate in the prior art.

BRIEF DESCRIPTION OF THE DRAWINGS

The above features, advantages and other aspects of the disclosure will become more apparent through the drawings and with reference to the detailed description below. Several embodiments of the present disclosure are described here exemplarily, without suggesting any limitation. In the drawings.

DETAILED DESCRIPTION OF EMBODIMENTS

In the following detailed description on preferred embodiments, reference will be made to the drawings appended as a part of the disclosure. By way of example, the drawings illustrate specific embodiments that can implement the disclosure. The example embodiments are not intended to exhaust all the embodiments of the disclosure. It would be appreciated that, without departing from the scope of the disclosure, other embodiments may be employed, or structural or logical amendments can be allowed. Therefore, the detailed description below is not restrictive, and the scope of the disclosure is defined by the claims appended.

As used herein, the terms "includes," "comprises" and its variants are to be read as open terms that mean "includes/comprises, but is not limited to." The term "based on" is to be read as "based at least partly on." The term "an embodiment" is to be read as "at least one embodiment;" the term "another embodiment" is to be read as "at least one another embodiment," and the like.

The technical problems to be solved by the disclosure lie in how to improve structural strength of an integrated antenna to further improve safety and reliability of the product, and how to reduce the manufacturing cost thereof.

To solve the above technical problems, an integrated antenna disclosed herein includes a reflective plate, a pair of mounting portions, a dielectric plate, a plurality of passive antenna elements and an active antenna unit. The mounting portions are respectively secured to two sides of a bottom of the reflective plate; the dielectric plate and the reflective plate are spaced apart on the pair of mounting portions, and a first surface of the dielectric plate is provided with a frequency selection surface; the plurality of passive antenna elements are respectively arranged on the reflective surface and the frequency selection surface; the active antenna unit is arranged above a second surface of the dielectric plate and secured to the pair of mounting portions.

Figure 1:
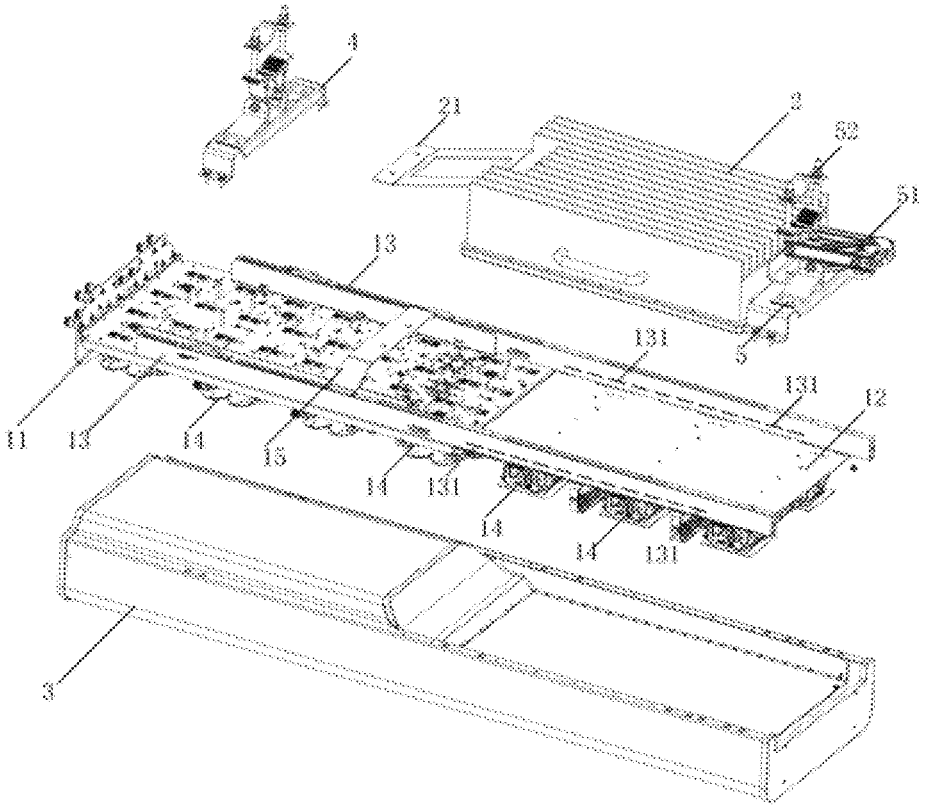
FIG. 1 is an exploded view of an active-passive integrated antenna according to the disclosure.

FIG. 1 illustrates an overall structure of an active-passive integrated antenna according to the disclosure. As shown therein, the integrated antenna includes: a reflective plate 11, a pair of mounting portions 13, a dielectric plate 12, a plurality of passive antenna elements 14, an active antenna unit 2, an antenna cover 3, a first mounting bracket 4 and a second mounting bracket 5.

As shown in FIG. 1, a pair of mounting portions 13 is secured to two sides of the bottom of the reflective plate 11, respectively, and the dielectric plate 12 and the reflective plate 11 are spaced apart on the pair of mounting portions 13. The plurality of passive antenna elements 14 are arranged on the reflective plate 11.

In the embodiment, in order to reduce impact or interference of the active antenna unit 2 on the passive antenna elements 14, the first surface of the dielectric plate 12 is provided with a frequency selection surface (not shown) such that the plurality of passive antenna elements 14 are directly or indirectly secured to the frequency selection surface. The active antenna unit 2 is disposed above the second surface of the dielectric plate 12 and secured to the pair of mounting portions 13, wherein the second surface is located opposite to the first surface.

Figure 5:
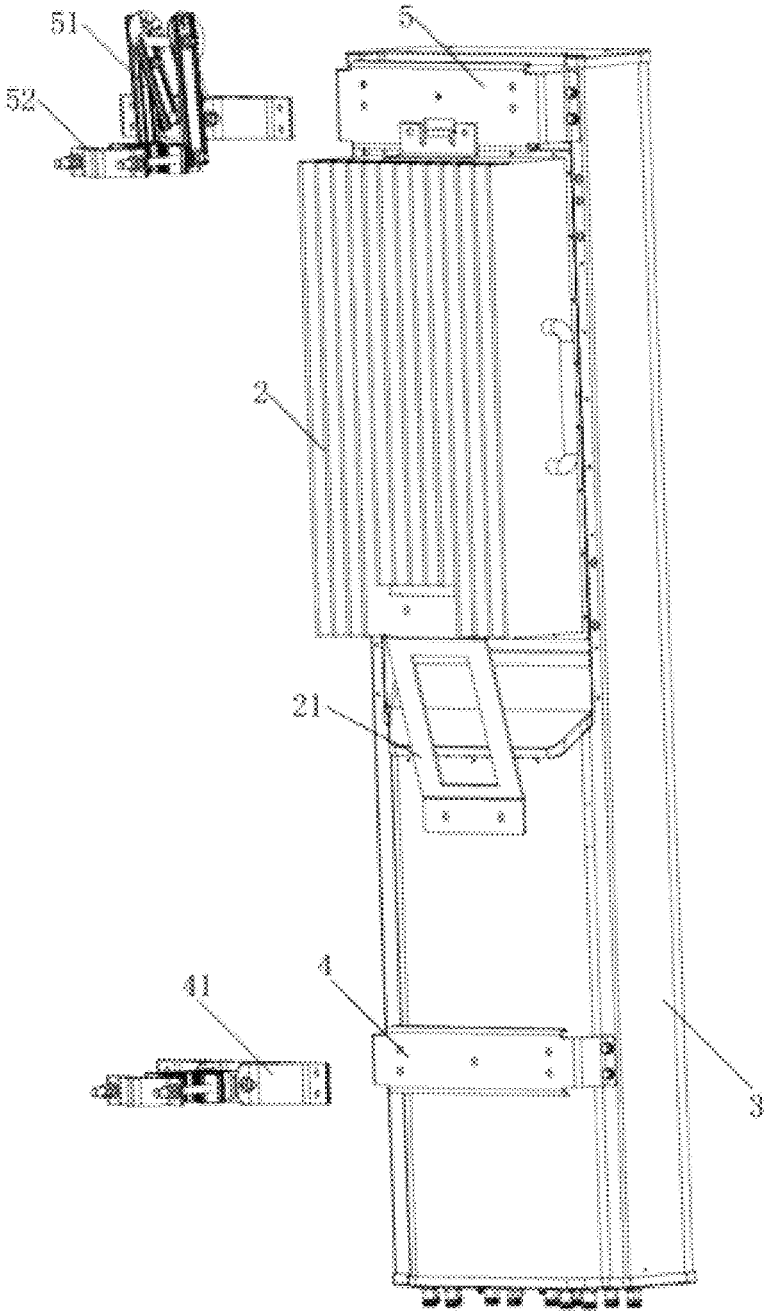
FIG. 5 is a view of an overall structure of an integrated antenna according to the disclosure.

In addition, as shown in FIG. 5, an antenna cover 3 receives therein the reflective plate 11, the pair of mounting portions 13, the dielectric plate 2 and the plurality of passive antenna elements 14, and the active antenna unit 2 can be secured outside of the antenna cover 3 via a connector such as a screw or the like, and can be fixedly connected with the pair of mounting portions 13 at the same time.

In this disclosure, with the arrangement of the pair of mounting portions 13 within the antenna cover 13, the entire mounting distance of the integrated antenna in the traverse direction perpendicular to the extending direction of the mounting portions 13 can be reduced, and thus wind load can be reduced and space can be saved.

Figure 2A:
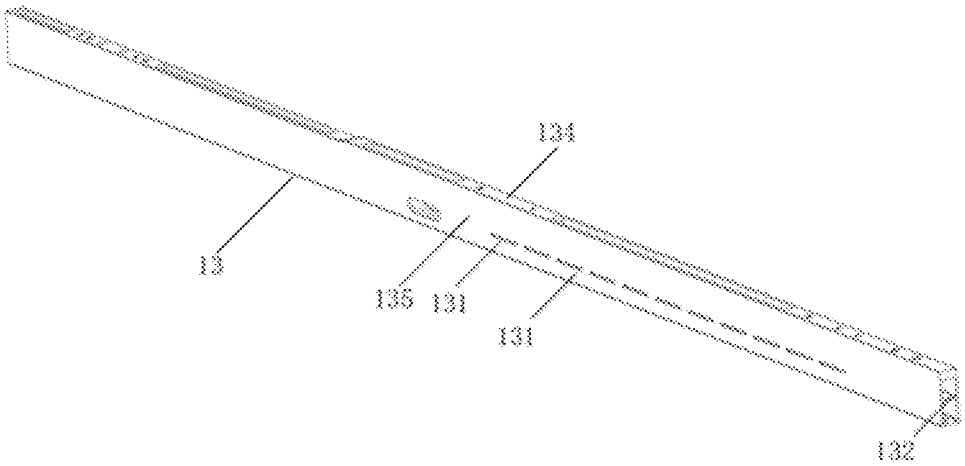
FIG. 2*a* is a three-dimensional structural view of a first example of a mounting portion of an integrated antenna according to the disclosure.
Figure 2B:
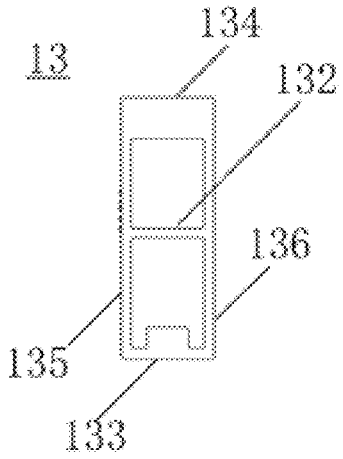
FIG. 2*b* is a first sectional view of the first example of the mounting portion of the integrated antenna according to the disclosure.
Figure 2C:
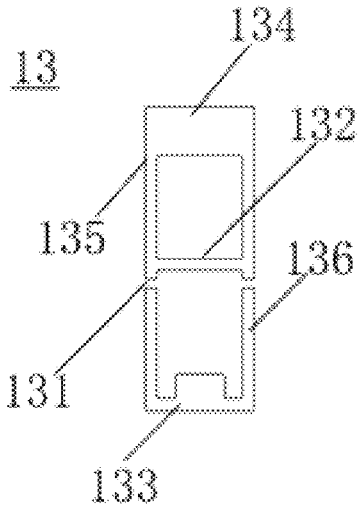
FIG. 2*c* is a second sectional view of the first example of the mounting portion of the integrated antenna according to the disclosure.

In a structure of a mounting portion 13 as shown in FIGS. 2*a*-2*c*, each mounting portion 13 is in a hollow rod shape. In the example, the mounting portion 13 has a rectangular section, and the mounting portion 13 is also provided therein with a reinforcement rib 132 to divide the section into two parts, which can improve lateral load strength of the mounting portion 13.

In the specific implementation process, the mounting portion 13 can be formed of sheet metal parts (e.g., aluminum alloy) by bending or pultrusion, or the mounting portion 13 can be formed of a composite material, so as to overcome the PIM (i.e., passive intermodulation) deficiency of the mounting portion 13 formed of aluminum alloy material.

In the present embodiment, the mounting portion includes a first side surface 133 and a second side surface 134 parallel to each other, and a third side surface 135 and a fourth side surface 136 respectively perpendicular to the first side surface 133. The reflective plate 11 and the dielectric plate 12 are respectively arranged on the first side surface 133 of the mounting portion 13, and the active antenna unit 2 is arranged on the second surface 134 of the mounting portion.

More specifically, the reflective plate 11 and the dielectric plate 12 can be secured to the pair of mounting portions 13 using a connector such as a screw, a rivet or the like, without providing openings on the reflective plate 11 and the dielectric plate 12.

The mounting plate 13 is further provided with a plurality of through holes 131. When the active antenna unit is arranged on the second side surface 134 of the mounting portion 13, the plurality of through holes 131 correspond to a plurality of active radiating elements of the active antenna unit 2, respectively, to thus enhance the strength of the radiated signal from the active radiating element, i.e., to improve the operating performance of the active antenna unit 2.

Figure 7:
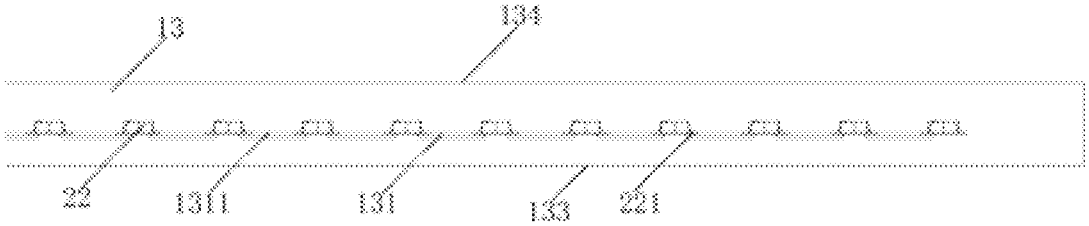
FIG. 7 is an exemplary view of a positional relation between a part of a mounting portion of an integrated antenna and an active radiating element according to the disclosure.

As shown in FIG. 7, at least a part of a radiating surface 221 of an active radiating element 22 is horizontally aligned with a first edge of a corresponding through hole 131; in the present embodiment, the first edge 1311 of the through hole 131 is proximal to the active antenna unit 2. Further, for the active radiating element 22 arranged within the active radiating unit 2, the radiating surface 221 of the active radiating element 22 is horizontally aligned with corresponding first edges 1311 of two adjacent through holes 131, respectively. With such design, the active radiating element 22 can achieve a better radiating effect during operation to facilitate signal transmission.

As shown in FIGS. 2*a* and 2*c*, a plurality of through holes 131 are spaced apart on the third side surface 135 and the fourth side surface 136 of the mounting portion 13, respectively.

In addition, the mounting portion 13 is further provided with a plurality of lightening holes 136 that can be arranged on the first side surface 133 and/or the second side surface 134 to reduce the overall weight of the mounting portion 13.

On one hand, the structure of the mounting portion 13 according to this embodiment can realize a lightening design of the mounting portion 13 without sacrificing the high dynamic rigidity of the integrated antenna; on the other hand, the design of the through holes 131 can enable the integrated antenna to achieve a better radio frequency performance.

Figure 3:
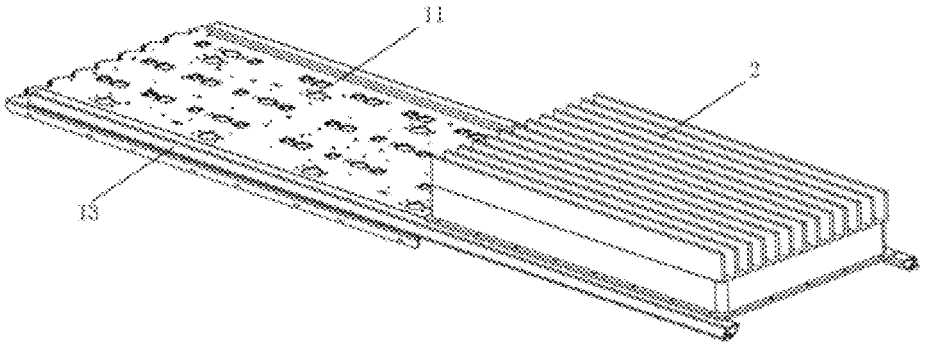
FIG. 3 is a partial structural view of an integrated antenna according to the disclosure.
Figure 4A:
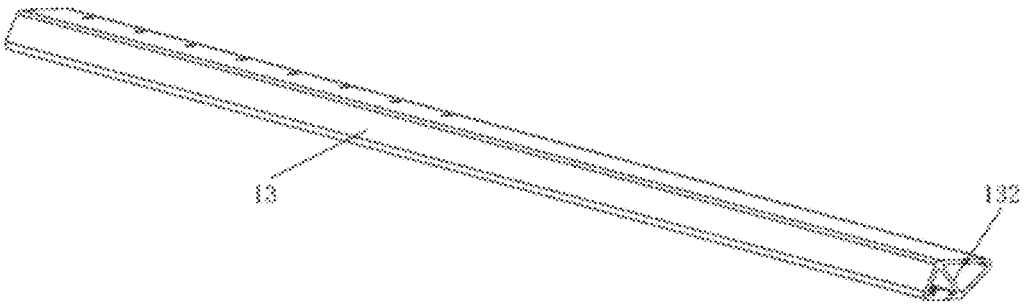
FIG. 4*a* is a three-dimensional structural view of a second example of a mounting portion of the integrated antenna according to the disclosure.
Figure 4B:
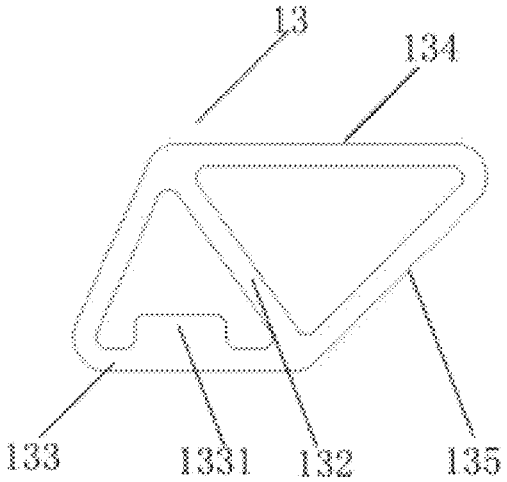
FIG. 4*b* is a sectional view of the second example of the integrated antenna according to the disclosure.

As shown in FIGS. 3-4*b*, a structure of another mounting portion 13 is disclosed. In the example, each mounting portion 13 has a trapezoidal section and is provided with a reinforcement rib 132 to make the trapezoidal section to be formed by two triangles, which can improve the load intensity of the mounting portion 13.

In the present example, the mounting portion 13 includes a first side surface 133 and a second side surface 134 parallel to each other, wherein the reflective plate 11 and the dielectric plate 12 can be arranged on the first side surface 133 via a screw, rivet or the like, and the active antenna unit 2 can be arranged on the second side surface 134 via a screw, rivet or the like. More specifically, the first side surface 133 has a first section length, the second side surface 134 has a second section length, and the first section length is less than the second section length.

More specifically, as shown in FIG. 4*b*, the first side surface 133 of the mounting portion 13 is further provided with a boss structure 1331, and the boss structure 1331 is provided therein with a threaded hole, to increase the connection distance of the threads for securing the reflective plate 11 or dielectric plate 12 in the longitudinal direction and to further improve the connection reliability between the mounting portion 13 and the passive antenna portion.

In addition, the structural design of the mounting portion 13 according to the present example has a bevel structure, i.e., the third side surface 135 respectively connected with the first side surface 133 and the second side surface 134 is designed in an inclined structure, which can improve the radiation range of the active antenna unit 2.

The two types of the structural designs of the mounting portion 13, as described above, can effectively solve the problems related to mounting of the integrated antenna and the structural strength of the whole antenna in a complicated load condition.

As shown in FIG. 1, the integrated antenna as disclosed herein further includes a support bracket 15 which is connected on two ends with the pair of mounting portions 13 respectively. In addition, the active antenna unit 2 includes a first side and a second side opposite to each other, wherein the first side includes a connection portion 21 connected to the antenna cover 3 such that the connection portion 21 is secured to the antenna cover 3 and the support bracket 15.

Figure 6:
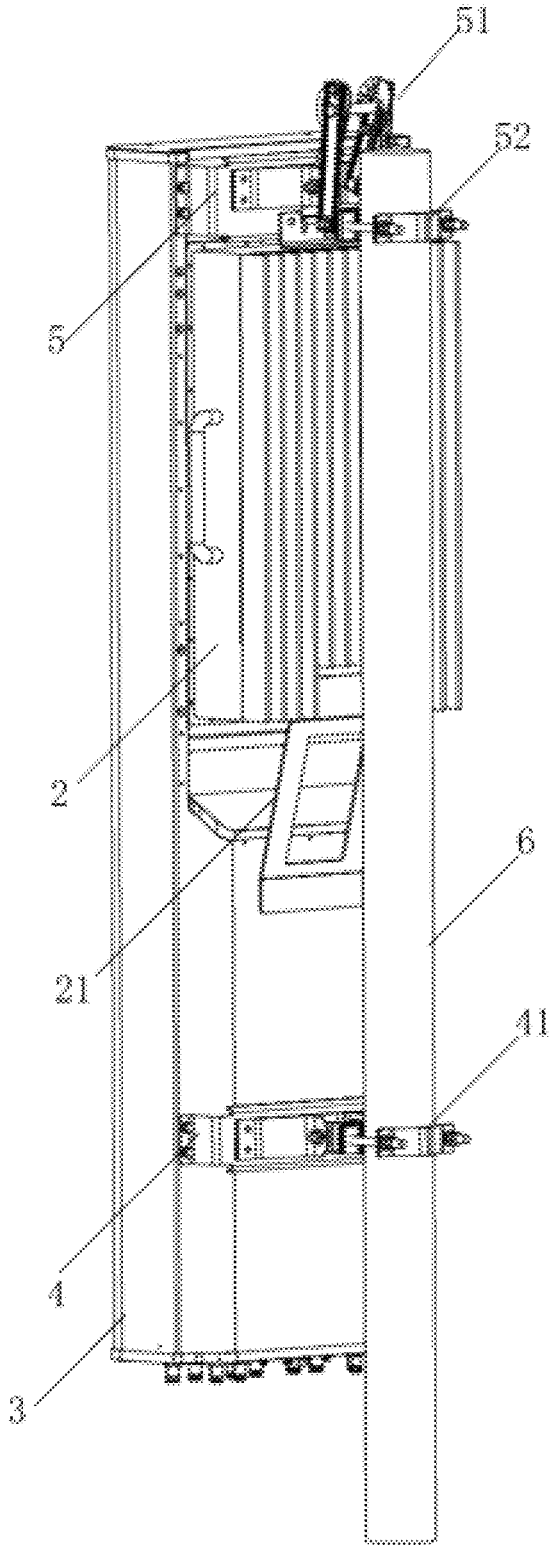
FIG. 6 is a schematic view of an integrated antenna according to the disclosure in in a usage scenario.

As shown in FIGS. 1, 5 and 6, the first mounting bracket 4 can be secured to the antenna cover 3 and the pair of mounting portions 13 via a connector such as a screw or the like, and the first mounting bracket 4 includes a first hoop structure 41. The second mounting bracket 5 is disposed on the second side of the active antenna unit 2, and includes a second hoop structure 52 and an adjustable member 51 connected with the second hoop structure 52.

As shown in FIG. 6, in the actual application, after assembled, the integrated antenna is secured to a pole 6 via the first hoop structure 41 and the second hoop structure 52, and the inclined angle between the integrated antenna and the pole 6 can be adjusted with the adjustable member 51.

In the disclosure, a plurality of mounting brackets are fixedly connected with the pair of mounting portions 13 and the antenna cover 3 at the same time, so as to improve the overall rigidity of the integrated antenna.

For the integrated antenna according to the disclosure, on one hand, the design with a pair of mounting portion can improve the rigidity of the mounting portions such that they can be safe and reliable in a complicated load condition; on the other hand, the design of the positions of the active radiating unit relative to the passive antenna elements can guarantee the simultaneous normal operation of the two and prevent them from interfering with each other; furthermore, the design of a pair of mounting portions being provided within an antenna cover can achieve the effect of reducing wind load and saving space.

The above described are only optional embodiments of the present disclosure, not constituting a limitation to the present disclosure. For those skilled in the art, lots of modifications and variations to the present disclosure are allowed. Within the spirit and scope of the present disclosure, any modifications, equivalent substitutions, improvements, and the like should all fall into the protection scope of the present disclosure.

Although the present disclosure has been described above with reference to some specific embodiments, it would be appreciated that the embodiments of the present disclosure are not limited to those described herein. The embodiments of the present disclosure intend to cover various modifications and equivalent arrangements within the spirits and scope of the appended claims. The scope of the appended claims shall conform to the broadest explanation, so as to cover all the modifications as well as equivalent structures and functions.

We claim:

1. An active-passive integrated antenna, comprising:

a reflective plate;

a pair of mounting portions respectively secured on two sides of a bottom of the reflective plate;

a dielectric plate spaced apart from the reflective plate on the pair of mounting portions, wherein the reflective plate does not include the dielectric plate, a first surface of the dielectric plate being provided with a frequency selection surface;

a plurality of passive antenna elements respectively arranged on the reflective plate and the frequency selection surface; and an active antenna unit arranged above a second surface of the dielectric plate and secured to the pair of mounting portions, wherein the second surface is located opposite to the first surface.

2. The active-passive integrated antenna of claim 1, wherein the active-passive integrated antenna further comprises an antenna cover, the reflective plate, the pair of mounting portions, the dielectric plate and the plurality of passive antenna elements are arranged within the antenna cover, and the active antenna unit is secured to the antenna cover and the pair of mounting portions.

3. The active-passive integrated antenna of claim 1, wherein each of the mounting portions is entirely in a hollow rod shape.

4. The active-passive integrated antenna of claim 3, wherein each of the mounting portions has a trapezoidal section and is provided therein with a reinforcement rib such that the trapezoidal section is formed by two triangles.

5. The active-passive integrated antenna of claim 1, wherein each of the mounting portions comprises a first side surface and a second side surface parallel to each other, the reflective plate and the dielectric plate are respectively arranged on the first side surface, and the active antenna unit is arranged on the second side surface; wherein the first side surface has a first section length, the second side surface has a second section length, and the first section length is less than the second section length.

6. The active-passive integrated antenna of claim 3, wherein each of the mounting portions has a rectangular section.

7. The active-passive integrated antenna of claim 6, wherein the mounting portion is further provided therein with a reinforcement rib such that the section is divided into two portions.

8. The active-passive integrated antenna of claim 6, wherein the mounting portion comprises a first side surface and a second side surface parallel to each other, and a third side surface and a fourth side surface respectively perpendicular to the first side surface, the reflective plate and the dielectric plate are respectively arranged on the first side surface, and the active antenna unit is arranged on the second side surface.

9. The active-passive integrated antenna of claim 8, wherein each of the mounting portions is further provided with a plurality of through holes that are respectively spaced apart on the third side surface and the fourth side surface.

10. The active-passive integrated antenna of claim 9, wherein the plurality of through holes respectively correspond to a plurality of active radiating elements of the active antenna unit, when the active antenna unit is arranged on the second side surface.

11. The active-passive integrated antenna of claim 10, wherein at least a part of a radiating surface of one of the active radiating elements is horizontally aligned with a first edge of a corresponding one of the through holes, wherein the first edge of the through hole is proximal to the active antenna unit.

12. The active-passive integrated antenna of claim 11, wherein a radiating surface of one of the active radiating elements is horizontally aligned with first edges of adjacent two of the through holes, respectively.

13. The active-passive integrated antenna of claim 8, wherein each of the mounting portions is further provided with a plurality of lightening holes arranged on the first side surface and the second side surface.

14. The active-passive integrated antenna of claim 2, wherein the active antenna unit comprises a first side and a second side opposite to each other, and the first side further comprises a connecting portion connected to the antenna cover.

15. The active-passive integrated antenna of claim 14, further comprising:

a first mounting bracket secured to the antenna cover and the pair of mounting portions and comprising a first hoop structure; and a second mounting bracket arranged on the second side and comprising a second hoop structure and an adjustable member connected to the second hoop structure.

16. The active-passive integrated antenna of claim 14, further comprising: a support bracket that is respectively connected at two ends with the pair of mounting portions such that the connecting portion is secured to the antenna cover and the support bracket.

* * * * *